United States Patent [19]

Gold

[11] Patent Number: 5,027,858

[45] Date of Patent: Jul. 2, 1991

[54] MULTISTAGE SERVOVALVES

[76] Inventor: Harold Gold, 3645 Tolland Rd., Shaker Heights, Ohio 44122

[21] Appl. No.: 401,779

[22] Filed: Sep. 1, 1989

[51] Int. Cl.[5] ..... F15B 13/043

[52] U.S. Cl. ..... 137/625.62; 137/596.15; 137/596.16

[58] Field of Search ..... 137/625.62, 596.16, 137/596.15

[56] References Cited

U.S. PATENT DOCUMENTS

| | | | |
|---|---|---|---|
| 2,832,318 | 4/1958 | Paine | 137/625.62 |
| 2,880,708 | 4/1959 | Hayner | 137/596.15 |
| 3,621,862 | 11/1971 | Wojtecki | 137/82 |
| 3,794,060 | 2/1974 | Perkins | 137/84 X |
| 3,799,498 | 3/1974 | Wickham et al. | 137/82 X |
| 4,623,003 | 11/1986 | Leonard | 137/625.62 X |

*Primary Examiner*—Gerald A. Michalsky

[57] ABSTRACT

Two and three stage servovalves having a first stage comprising a torque-motor driven, double jet, flapper valve, extend the present art in dynamic response through the replacement of the present flapper valve inlet orifices with active flow controllers. The flow controllers hold the flow rate from the pressure supply substantially constant under varying supply pressure and under varying operating conditions of the flapper valve and of the second and third stages. The flow controllers increase the gain of differential pressure to flapper displacement, through which the flapper to nozzle null gap can be reduced which, in turn, further increases the gain of differential pressure to flapper displacement and reduces the total flapper stroke. The stroke reduction reduces the torque-motor centering spring force, through which the torque-motor limited differential pressure can be increased. These factors significantly extend the operating supply pressure range and extend the frequency band of second and third stages of multistage servovalves.

4 Claims, 14 Drawing Sheets

.25
0
-.25
INCHES
STEP
75
74
74
75

4
2
0
CU.IN./SEC 4
2
0
CU.IN./SEC
0
4
8
12
16
20
24
28
TIME MILLISECONDS

.25
0
-.25
INCHES
102
103
103
103
STEP 500
250
0
P.S.I.
104
105

500
250
0
P.S.I
106
107
0
10
20
30
40
50
60
70
TIME MILLISECONDS

.25
0.
-.25
INCHES
108
109
108
109
109
108
STEP 500
250
0
P.S.I.
110
111

500
250
0
P.S.I.
112
113
0
10
20
30
40
50
60
70
TIME MILLISECONDS

.01
0.
-.01
SPOOL-INCHES
130
129

.002
0
-.002
FLAPPER-IN.
131
132

75.
0.
-75.
PRES-DIFF-P.S.I.
133
134
0
.5
1.
1.5
2.
2.5
3.
3.5
TIME-MILLISECONDS

MULTISTAGE SERVOVALVES

BACKGROUND OF THE INVENTION

High response, multistage servovalves have been used successfully for over four decades. Almost invariably, the first stage of the servovalve is a double jet flapper valve with a torque-motor actuated flapper and requires a high and constant supply pressure, in the 3000 psi range. This pressure range and the requirement for constant pressure are not suitable to many industrial applications. For this reason, the investigation upon which this Application is based had as its initial goal, the use of low pressure, multistage servovalves in systems where the supply pressure could vary between 500 and 3000 psi. This goal has been met through this invention, but it has also been found that the application of the invention to the high pressure, multistage servovalve significantly extends its frequency response and extends the supply pressure range to below 50 percent of design pressure.

Double jet flapper valves which are in wide use employ a torque-motor driven flapper that is placed between two jet nozzles. Each jet nozzle is fed from a pressure source through an orifice. The torque-motor is spring centered to null position. At null position, the flapper is centered between the two nozzles, the nozzle pressure forces are balanced and the spring force and the torque-motor current are essentially zero. When the current through the torque-motor coil and consequently the electro-magnetic force are increased from zero, in either direction, the spring force acts in opposition to the flapper deflection and the deflection produces a nozzle pressure difference that also oppose the deflection. An additional opposing force that may act on the flapper is the second stage feedback force, where used. At a given flapper deflection from the null position, there is a force balance between the forces that act on the flapper: the spring force, the pressure force, the second stage feedback force and the electro-magnetic force.

The pressure difference between the two nozzle that is provided by the orifice fed flapper valve is proportional to the flapper deflection from null and to the supply pressure. A further effect of supply pressure is that the gain of pressure difference to torque-motor current also increases with supply pressure. In pressure control servo systems, the second effect can lead to system instability if the supply pressure is raised. In addition, in flapper valves designed for low supply pressure, as is functional in pressure control systems, the high null flow accompanying a substantial supply pressure increase may cause disruptive pressure drops in flow passages. Flow control servovalves which have been designed for high response operate at relatively high supply pressure, usually 3000 psi. The inlet orifice diameter, jet nozzle diameter and nozzle gap are matched, in design for a given null flow rate and pressure differential range, only at 3000 psi supply pressure. Because of the nonlinearity of the flow-pressure relationship, there can be serious loss in pressure differential if the supply pressure is reduced only 25 percent and an almost complete loss of function at 50 percent. This characteristic sensitivity of both types of servovalves to supply pressure makes them difficult to apply to the recently developed load responsive systems where the supply pressure is varied for efficiency.

SUMMARY OF THE INVENTION

In the present invention, means are provided that make both types of multistage servovalves, functionably independent of supply pressure, at or above approximately 500 psi. To obtain this, the inlet orifices of the flapper valve are replaced with active flow control devices. This change makes the pressure difference of the flapper valve and the pressure difference to torque-motor gain independent of the supply pressure. In addition, at the same null flow rate as provided by the inlet orifices, the required flapper deflection for a given pressure difference is significantly reduced, through which the flapper centering spring force diminishes, and the torque-motor-limited maximum pressure difference is significantly increased. The pressure independence and the reduced deflection provided by this invention permits the flapper null gap to be reduced. The combined effects of active flapper inlet flow control and reduced null gap provide marked improvements in the dynamic response of two and three stage systems.

The effects of replacing both inlet orifices with flow regulators has been investigated, by the inventor, on three types of electro-hydraulic multistage servovalves: 1. A low supply pressure, pressure control flapper with a pressure control second stage and with a spring centered output stage; 2. A low supply pressure, pressure control flapper with spring centered, flow control, second stage and electric feedback of the output stage position; 3. A high supply pressure flow control servovalve with force feedback of second stage spool position to the flapper. The basis for improvement of the three systems is demonstrated and the improved output stage transient and frequency responses of the systems are shown. Accordingly, it is a principle object of this invention to provide a multistage servovalve having a double jet flapper valve first stage assembly, that is capable of maintaining a high response and other desirable characteristics when supplied from a pressure supply which, for maximum effectiveness, be permitted to vary from 3000 psi to as low as 500 psi.

It is another object of this invention to provide a three stage servovalve assembly, having a first stage double jet, pressure control, flapper valve that is torque-motor limited to 500 psi supply pressure to be operable, with no loss of maximum pressure differential, at supply pressures in the 3000 to 5000 psi range.

It is yet another object of this invention is to provide a three stage servovalve system with position feedback from the third stage spool and in which the first stage is a double jet flapper valve and the second stage is a spring centered four-way valve spool, in which all stages can be operated from a common supply pressure, and in which the first stage output is independent of the supply pressure.

It is still a further object of this invention is to provide a two stage servovalve in which the first stage is a double jet flapper valve and the second stage is coupled through force feedback means to said flapper, and in which the first stage output is independent of the supply pressure.

Briefly, the foregoing and other objects and advantages of this invention are accomplished by providing a flapper valve stage in which the inlet orifices of the prior art are replaced by flow regulator valves, or other active flow control means. The very important benefits to be derived from the use of these flow control means will be fully described in conjunction with the following drawings.

Additional objects of this invention will become apparent when referring to the preferred embodiments as shown in the accompanying drawings and described in the following description.

DESCRIPTION OF THE DRAWINGS

FIG. 5 is a graph illustrating the transient response of the output stage of the system defined by FIG. 1 under the orifice fed flapper valve and under the flow regulator fed flapper valve, and showing the simultaneous response of the flow regulators.

DETAILED DESCRIPTION OF THE INVENTION

Figure 1:
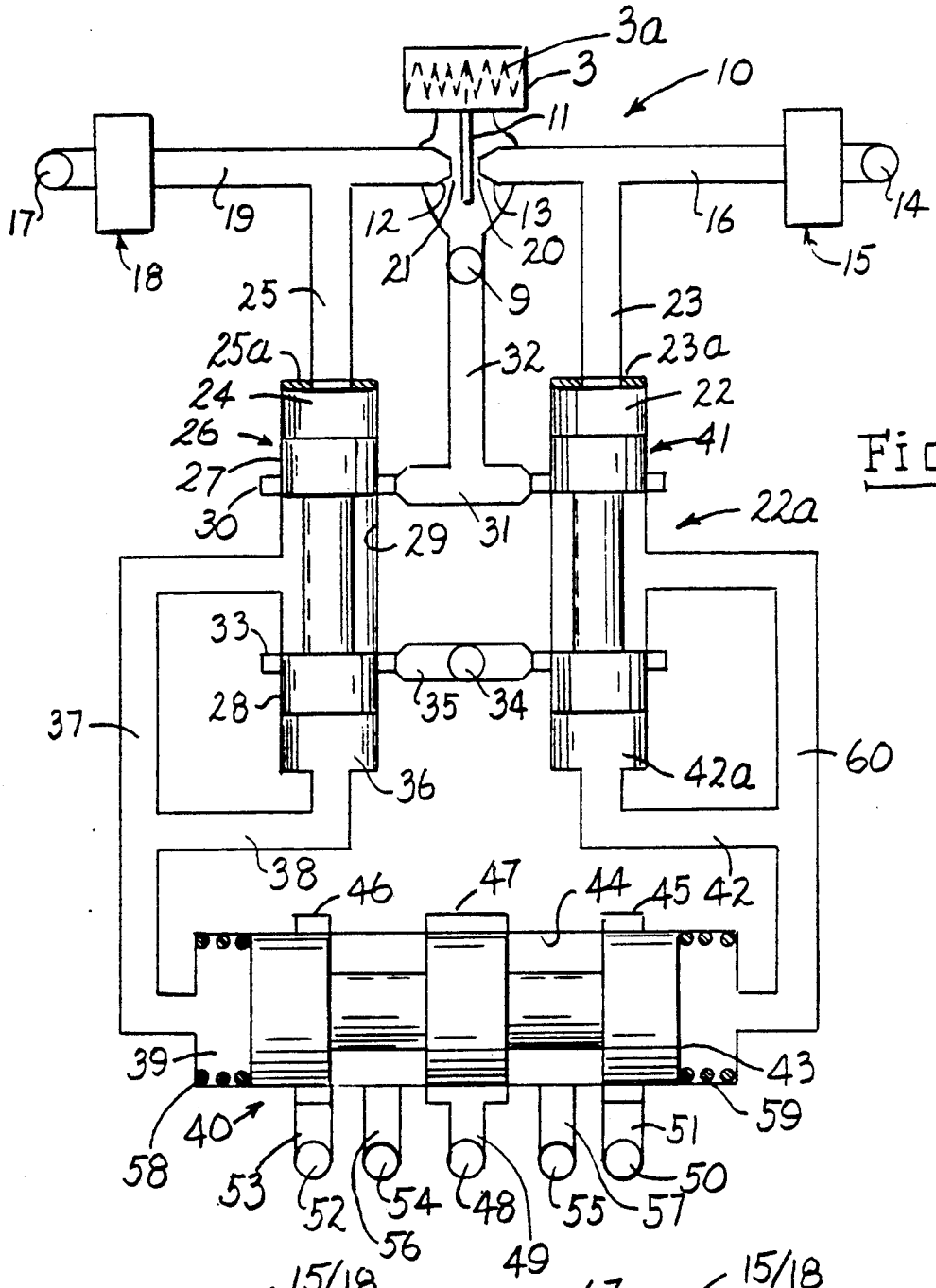
FIG. 1 is a schematic drawing of a pressure control flapper valve, with blocks representing flapper inlet devices, driving a second stage, flow amplifying spool valves which transit the flapper valve pressures to a spring centered output spool.

Important flapper valve advantages which come from the use constant flow devices in place of inlet orifices can be shown through the set of relatively simple blocked load equations which follow:

Inlet Orifice Fed Equations

Let:

$a_1$ — area of first flapper orifice
$a_2$ — area of second flapper orifice
$a_s$ — area of inlet orifice
$P_s$ — supply pressure
$P_1$ — pressure on first flapper side
$P_2$ — pressure on second flapper side
$Q_1$ — flow rate through $a_1$
$Q_2$ — flow rate through $a_2$
K — dimensional constant Each side of the flapper valve consists of two orifices in series. Equating the inlet and the outlet flow rates in the series set and solving for the inter orifice pressure we obtain:

$$P_1 = P_s/[1 + a_1^2/a_s^2] \quad (1)$$

$$P_2 = P_s/[1 + a_2^2/a_s^2] \quad (2)$$

$$Q_1 = Ka_1(P_1)^{.5} \quad (3)$$

$$Q_2 = Ka_2(P_2)^{.5} \quad (4)$$

Flow Regulator Fed Flapper Equations

The flow regulators hold $$Q_1 = Q_2 = Q_R$$

Where $Q_R$—constant flow rate held by each flow regulator

The values of $P_1$ and $P_2$ are then:

$$P_1 = (Q_R/Ka_1)^2 \quad (5)$$

$$P_2 = (Q_R/Ka_2)^2 \quad (6)$$

Torque-motor Force Balance

Considering the component of torque-motor force along the axis of the nozzles 12 and 13, the force balance can be expressed:

$$T_F = A_N(P_1 - P_2) + K_S D_Y \quad (7)$$

From which:

$$(P_1 - P_2)_{max} = T_{Fmax} - K_S D_Y \quad (8)$$

Where:

$A_N$—flow nozzle area $D_Y$—flapper axial deflection from null position $K_S$—torque-motor spring rate $T_F$—torque-motor axial force Equation (8) shows clearly that if the required flapper deflection is reduced, the maximum pressure difference increases. Equations (5) and (6) show that with flow regulation, the response of the flapper pressures to flapper area is proportional to the square of the flow rate.

In FIG. 1 torque motor 3 of flapper valve assembly 10 positions flapper 11 between flow discharge nozzles 12 and 13. The torque-motor 3 in assembly 10 is of conventional electro-magnetic and mechanical construction. The torque-motor armature is conventionally spring centered, which is represented symbolically at 3*a*, and it is mechanically coupled to flapper 11. Pressure port 14 provides hydraulic oil, or the like, to flow control assembly 15, from which the oil flows to nozzle 13 through passage 16. On the opposite side pressure port 17 provides oil to flow control assembly 18 from which it flows to nozzle 12 through passage 19. As is broadly known, the gaps between the flapper and the nozzles form flow orifices 20 and 21 which decrease in flow area when the flapper moves toward the nozzle and increase in flow area when the flapper moves away from the nozzle. At null, the flapper is centered between the two nozzle faces and orifices 20 and 21 have the same flow area. The flow from orifices 20 and 21 discharge into drain port 9. As is well known, the modulation of orifices 20 and 21 by flapper 11 produces complementary pressure changes in passage 16 and passage 19. These pressures are transmitted to second stage spool valve assembly 22*a* through passages 23 and 25.

The pressures in passages 16 and 19 are transmitted to second stage spool valve assembly 22*a* through passages 23 and 25 respectively. The pressure in passage 16 is transmitted to chamber 22 of spool valve 41 through port 23*a*, and the pressure in passage 19 is transmitted to chamber 24 through port 25*a*. Spool 26 has lands 27 and 28 and slidably fitted in bore 29. Annulus 30 in bore 29 communicates with drain port 9 through passages 31 and 32. Annulus 33 in bore 29 communicates with pressure port 34 through passage 35. Chamber 36 communicates with output passage 37 through passage 38. In the center position, as drawn, annulus 30 is closed by land 27 and annulus 33 is closed by land 28. If the pressure in chamber 36 is greater than the pressure in passage 19, spool 26 moves upward, thereby communicating passage 37 with drain port 9. The spool returns to center position when the pressures equalize. If the pressure in chamber 36 is less than the pressure in passage 19, spool 26 moves downward, thereby communicating passage 37 to pressure port 34. The spool returns to center position when the pressures equalize. This well known action makes the pressure delivered to chamber 39 of spool valve 40 substantially equal to the pressure in passage 19 under load flow much greater than could be supplied by the flapper valve alone. Spool 41 is identical to spool 26 and the response of spool 41 to the pressures in chambers 22 and 42*a* is the same as the response of spool 26 to the pressures in chambers 24 and 36.

In third stage four way spool valve assembly 40, spool 43 which is slidably fitted in bore 44, forms a conventional four-way valve with drain annuli 45 and 46 and pressure annulus 47. Pressure port 48 communicates with annulus 47 through passage 49. Drain port 50 communicates with annulus 45 through passage 51 and drain port 52 communicates with annulus 46 through passage 53. Load ports 54 and 55 communicate with the inter-land spaces of spool 43 through passages 56 and 57 respectively. Springs 58 and 59 press with equal force when the pressures in passages 37 and 60 are equal and the spool 43 is centered. When flapper 11 is deflected from the null position the flapper pressure differential increases. This pressure differential is transmitted to spool 43 by the described action of spools 26 and 41. Spool 43 is then driven against the centering springs until the spring centering force equals the pressure differential force.

Figure 2:
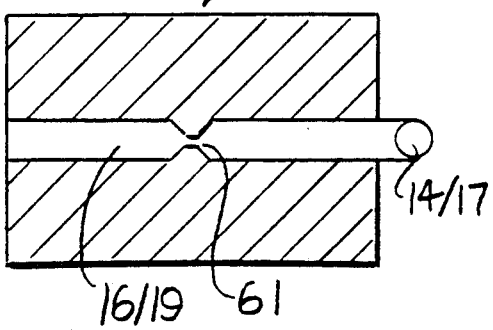
FIG. 2 is a schematic drawing which defines the flapper inlet device in FIG. 1 as a fixed orifice, which is accordance with the prior art.

FIG. 2 illustrates the form taken by the flow control assembly 15/18 in the prior art. In this form, orifice 61 communicates, on the upstream side with the pressure port 14/17 and discharges into passage 16/19.

Figure 3:
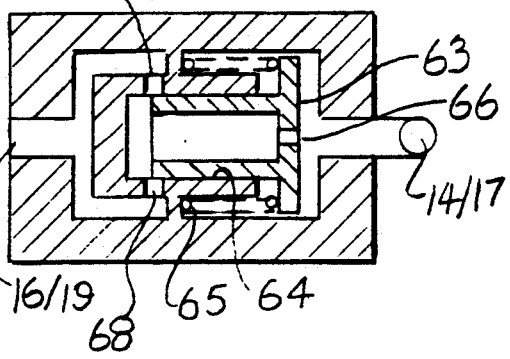
FIG. 3 is a schematic drawing which defines the flapper inlet device in FIG. 1 as a flow regulator, which is in accordance with this invention.

FIG. 3 illustrates one preferred embodiment of active flow control that can perform the function of flow control assemblies 15 and 18. This embodiment was employed in obtaining the performance information that is presented in later paragraphs and is well known as a fixed flow regulator. It comprises piston 63, bore 64 and spring 65. Through the well know action of this device, the pressure drop across orifice 66 urges the piston to move across holes 67 and 68 in the closing direction and spring 65 urges the piston in the opening direction. By means of this action, the pressure drop across orifice 66 is made substantially constant under varying pressure difference across the assembly. In this application, flow enters from pressure port 14 and discharges into passage 16 and enters from pressure port 17 and discharges into passage 19. I have found that the dynamic response of this configuration can meet the requirements of very fast flapper valves, in the full range of flapper nozzle diameters in current and expected use.

Figure 4:
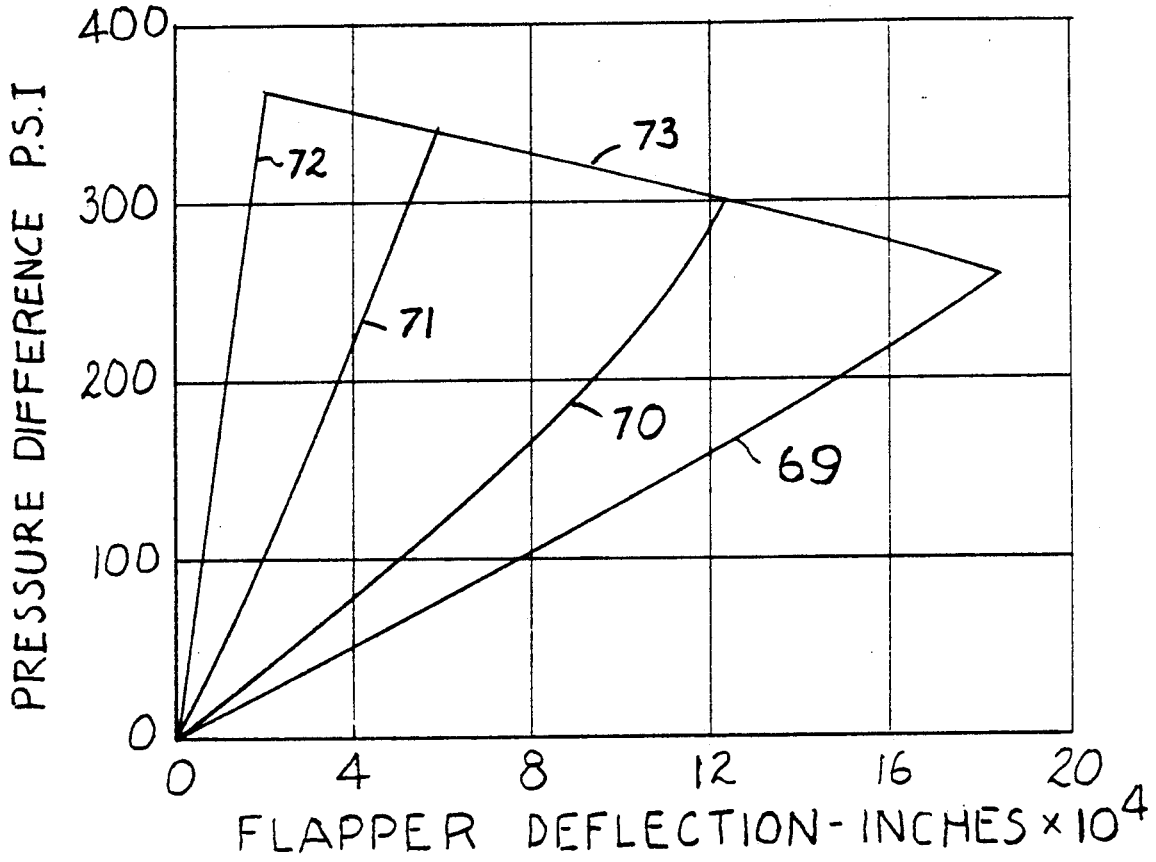
FIG. 4 is a plot showing the blocked load variation of pressure differential with flapper deflection of the flapper valve employing both inlet orifices and inlet flow regulators and the additional increase in pressure differential with the gap reduction allowable with inlet flow regulators.

FIG. 4 shows the blocked load variation of pressure differential with flapper deflection of a flapper valve employing both inlet orifices and inlet flow regulators, as calculated by the blocked load equations given earlier and the following dimensional data:

TABLE 1

| Flapper and Torque-motor Data | |
|---|---|
| Design supply pressure | 500 psi |
| Nozzle diameter | .125 inches |
| Inlet orifice diameter | .035 inches |
| Null flapper gap | .0035 inches |
| Null flow rate per side | 1.7625 cu. in./sec. |
| Torque-motor spring rate | 800 lb/in |
| Max torque-motor force (on nozzle axis) | 4.64 lbs |

The blocked load equations are applicable to the system of FIG. 1 because in steady state spools 26 and 41 are at rest. Even during transients, the axial motion the spools is of very small amplitude. In FIG. 4, line 69 displays the variation of differential pressure of the orifice fed case and was calculated with equations (1) and (2), with Table 1 values. Lines 70 and 71 were calculated from equations (5) and (6) with the regulator flow rate equal to 1.7625 cu./in./sec.. On lines 69 and 70 the null gap is 0.0035 inches and on line 71 the null gap is 0.0025 inches. The null gap on line 72 is 0.001 inches and the flow regulators are set at 0.8 cu.in./sec.. The limit line, line 73 was calculated with equation (8) and Table 1 values. The null pressures are 164.4 psi on lines 69 and 70, 322.2 psi on line 71 and 415 psi on line 72. The higher null pressure on line 71 and 72 results from the regulator flow rate passing through the smaller nozzle gaps orifice. The increase of maximum pressure differential of 264 psi on line 69 to 365 psi on line 72 is of great advantage to pressure control servovalves.

The increase in slope and the maximum pressure difference of line 70 over line 69, under identical conditions of null flow rate and flapper gap, shows that there is a significant improvement in flapper valve performance directly attributable to the replacement of the inlet orifices with flow regulators. The increase in slope and maximum pressure difference of line 72 over line 71 shows the flow regulators can provide further improvements. By way of example, if the null gap is reduced to 0.0015 inches and the flow regulator is set for a flow rate of 1.51 cu.in./sec., the null pressure would be 164.4 psi and the operating line would be very similar to line 71. This step would provide a flapper valve power reduction of 35%, without loss of performance. The selection of null gap and regulator flow rate involve design trade-offs that are made to optimize the complete system.

Figures 5A, 5B, 5C:
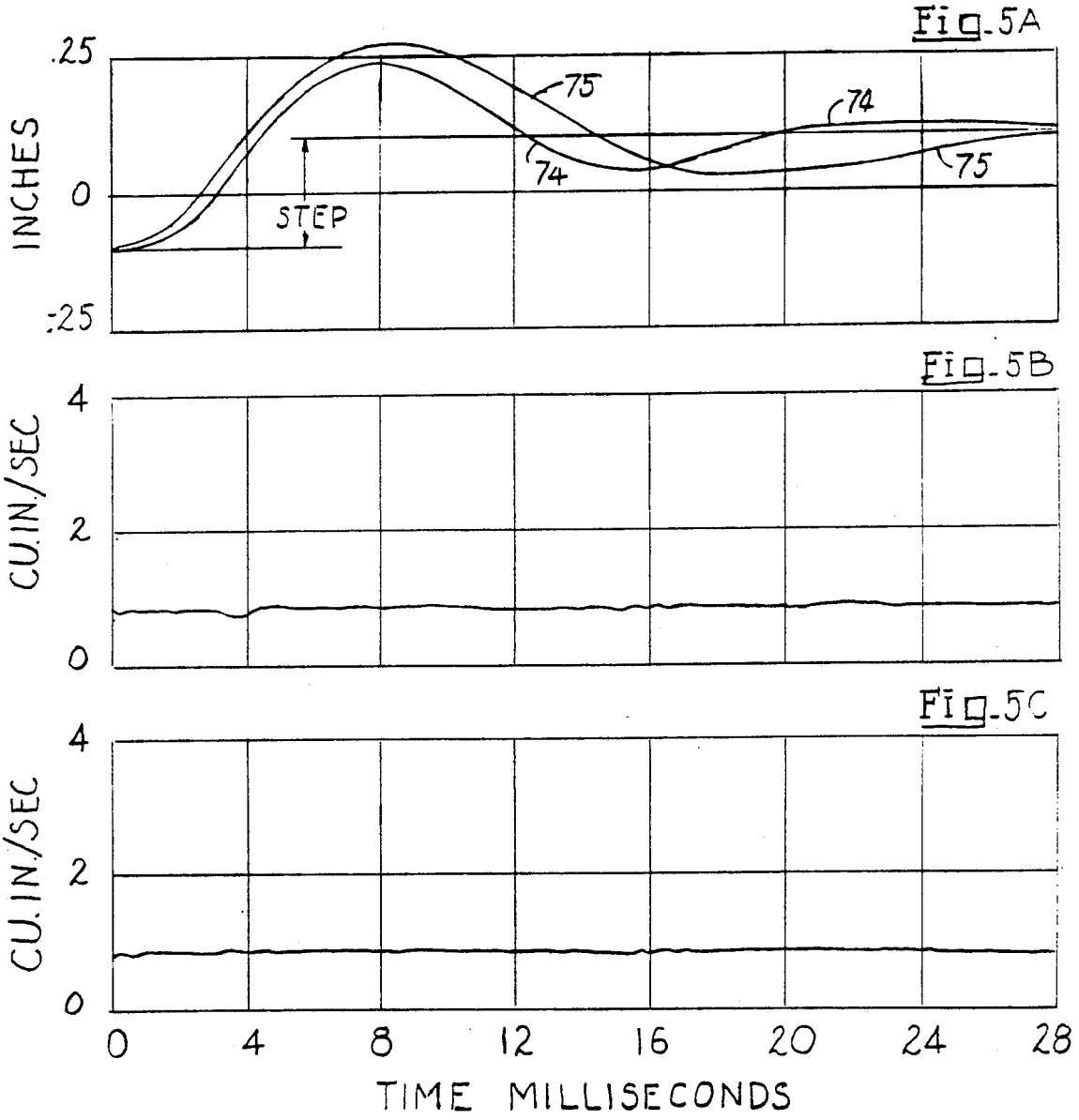
FIG. 5A is a graph showing the transient response of the output stage of the system defined by FIG. 1 under the orifice fed flapper valve and under the flow regulator fed flapper valve.
FIG. 5B is a graph showing the response of one flow regulator, on the same time scale as FIG. 5A, and occurring simultaneously.
FIG. 5C is a graph showing the simultaneous response of the second flow regulator.

FIG. 5A illustrates the transient response of a 3rd stage in a system in accordance with FIG. 1, with two flapper valves. The response shown by line 74 was obtained with a flow regulated flapper valve with the properties shown by line 72 in FIG. 4. The response shown by line 75 was obtained with an inlet orifice controlled flapper valve with the properties shown by line 69 in FIG. 4. The supply pressure for the orifice controlled flapper valve was 500 psi. The low flow rate of the flow regulated flapper permitted the supply pressure to be raised to 1100 psi for equal flapper valve power. If the orifice system flapper valve were supplied at 1100 psi the null flow would rise to 2.5685 cu.in./sec.. The pressure supplied to the second stage of the FIG. 1 system has no significant effect on the system response and was held at 500 psi. The 3rd stage centering spring rate was set, in both case, to provide a stroke of 0.25 inches at maximum flapper pressure differential. This condition set the spring rate at 554.85 lb./in. on the flow regulator system and 333.512 lb/in. on the orifice system. The higher centering spring rate of the flow regulator system is due to the higher pressure differential it produces. The higher spring rate reduces sensitivity to vibration and shock, an important factor in spring centered systems. In FIG. 5A, the area of deviation of lines 74 and 75 from the command line over the 28 milliseconds of the trace, obtained by integration with Simpson's rule is 0.00033 inch seconds for line 74 and 0.00042 inch seconds for line 75. This represents a 21% transient error reduction through use of the flapper valve with inlet flow regulators. FIGS. 5B and 5C show the variation of the flow regulator outputs during the transient. It can be seen that the flow rates are only slightly affected by the transient conditions, even during the most rapid changes in 3rd stage position.

Figure 6:
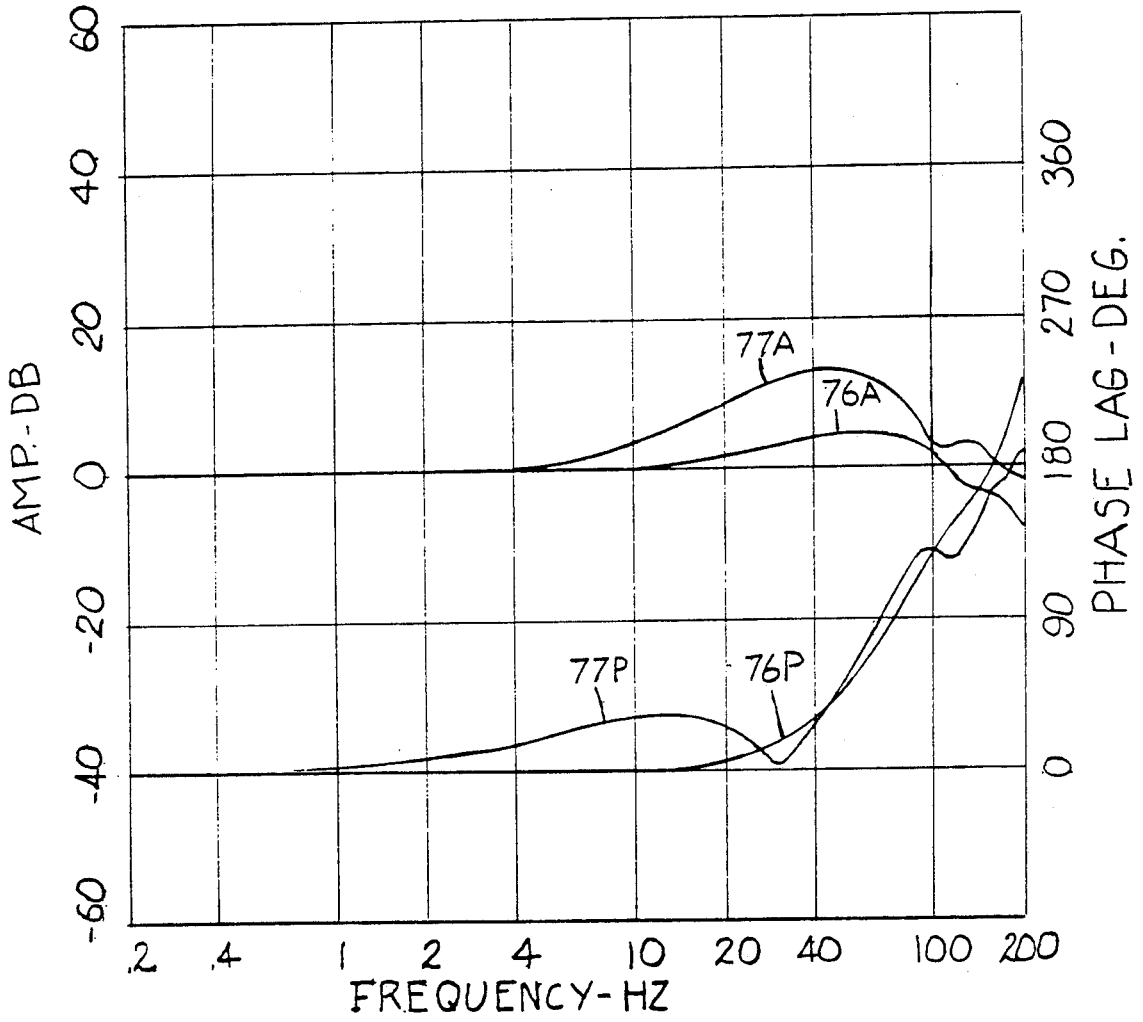
FIG. 6 is a graph illustrating the frequency response of the output stage of the system defined by FIG. 1 under the orifice fed flapper valve and under the flow regulator fed flapper valve.

FIG. 6 shows the frequency response of the 3rd stage spool to the torque-motor input. Lines 76*a* and 76*p* show the amplitude and phase responses, respectively, of the system with the inlet flow regulators and having differential pressure gain characteristics defined by line 72 of FIG. 4. Lines 77*a* and 77*p* show the amplitude and phase response, respectively, of the system with the inlet orifices and having differential pressure gain characteristics defined by line 69 of FIG. 4. The amplitude line 77*a* shows a resonant peak of 14db at 48 hz and a phase lag of 36 degrees at 12.6 hz. The flow regulator system shows a reduced resonant peak of 4.6 db at 63 hz and essentially O phase lag at 12.6 hz. In addition, it can be seen that the phase lag of the flow regulator system is very linear whereas the phase lag of the orifice system is distorted. It will be understood by those skilled in the art that the amplitude and phase characteristics of the flow regulator system will be of benefit to the stability and dynamic performance of the system being driven by the 3rd stage spool.

Figure 7:
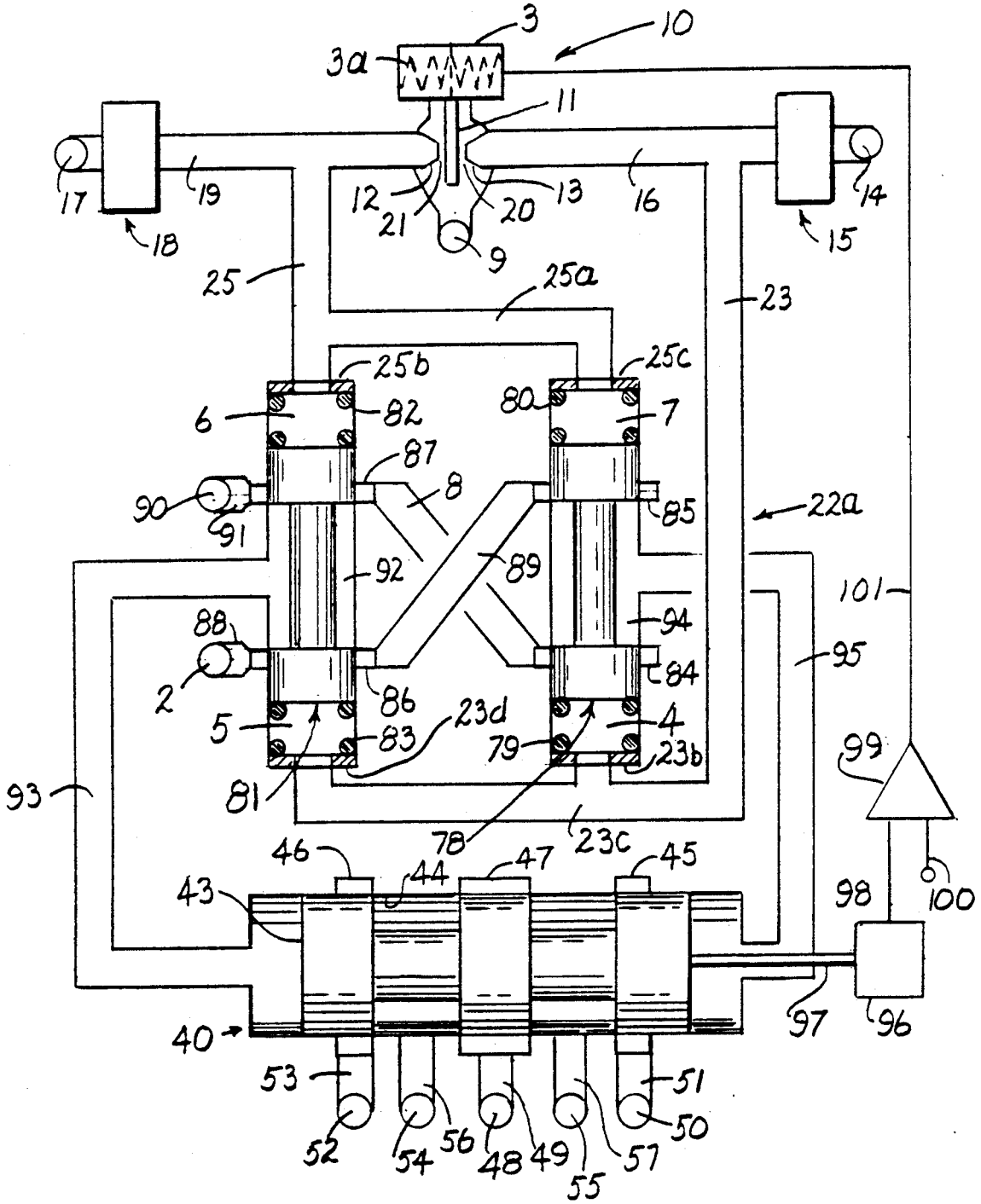
FIG. 7 is a schematic drawing of a pressure control flapper valve, with undefined flapper inlet devices, driving spring centered, second stage spool valves which transmit flow from a second source to an output spool valve. The position of the output spool is electrically fed back to a servo-amplifier which drives the torque motor of the flapper valve.

In FIGS. 1 and 7, the torque-motor, the flapper valve and the use of the flow control assemblies of FIGS. 2 and 3 are identical. Flapper valve parts that are common to FIG. 1 and FIG. 7 are identified by the same numbers. Output spool parts, which are identical in FIGS. 1 and 7 are also identified by the same numbers. In FIG. 7, the pressure in passage 16 communicates with chambers 4 and 5 through passage 23, its extension 23*c* and ports 23*b* and 23*d*. The pressure in passage 19 communicates with chambers 6 and 7 through passage 25, its extension 25*a* and ports 25*b* and 25*c*. Spool 78 is centered between chambers 4 and 7 by springs 79 and 80 and spool 81 is centered between chambers 5 and 6 by springs 82 and 83. Annuli 84 and 85 are closed by the lands of spool 78 when spool 78 is centered. Annuli 86 and 87 are closed by the lands of spool 81 when spool 81 is centered. Annulus 86 communicates with pressure port 2 through passage 88 and with annulus 85 through passage 89. Annulus 87 communicates with drain port 90 through passage 91 and with annulus 84 through passage 8. Chamber 92, which is formed between the lands of spool 81 communicates with output spool 43 through passage 93. Chamber 94, which is formed between the lands of spool 78 communicates with output spool 43 through passage 95.

Spool 43 is structurally connected to position-transducer 96 by rod 97. Transducer 96 communicates by wire 98 with servo-amplifier 99. Command input wire 100 communicates the command position signal to the servo-amplifier 99. Wire 101 carries the electric power from the servo-amplifier to torque-motor assembly 10.

The torque-motor of assembly 10 is of the well known electro-magnetic type and positions flapper 11 in the gap between nozzles 12 and 13. The force generated by the torque-motor is balanced by the internal torque-motor spring and the pressure forces that act on the flapper. The servo-amplifier is also of the well known type, being capable of amplifying the difference between the feedback and command signals, through a manually adjustable gain. It will be recognized by those skilled in the art that spools 78 and 81 in FIG. 7 are the functional equivalent of a single, three land spool and that the combined action of spools 78 and 81 is equivalent to that of a single four way valve. The advantages of one of these configurations over the other are not relevant to this invention.

Response curves of a system in accordance with FIG. 7 are shown in FIGS. 8A–12. The flapper stage is in accordance with Table 1 data and the second and third stage spools are appropriately sized. In the case of the orifice fed system, blocks 15 and 18 in FIG. 1 are fixed orifices, and in the flow regulator case the blocks 15 and 18 are flow regulators in accordance with FIG. 3. In the orifice fed case, the flapper null gap is 0.0035 inches (as given in Table 1), the pressure ports 14 and 17 are connected to 500 psi supplies and the pressure port 2 is connected to either a 500 psi supply or higher. In the flow regulator fed case, the flapper null gap is 0.0025 and ports 14, 17 and 27 are connected to a common pressure supply. In all runs, the flow regulator orifice 66 and the bias of spring 64 were sized to control the flow rate at 1.7625 cu.in./sec.. All transients are in response to a step in input command to drive the third stage spool from −0.1 to +0.1 inches position. The servo-amplifier gain is adjusted to provide a torque-motor force of 12 lb per inch of spool position error, with a force limit of 4.64 lbs. The centering spring rate of the second stage spools was 400 lb./in. in the inlet orifice system and 800 lb./in. in the inlet flow regulator system. The difference in second stage spool spring rate was used to match the loop gains of the two systems. The fixed 500 psi supply to the inlet orifices was imposed so that performance comparisons could be based on equal null flow rates. For example, if the highest pressure used, 3000 psi, were applied to the inlet orifices, the null flow rate would rise to 8.36 cu.in./sec (assuming no internal flow path limiting).

Figure 8A:
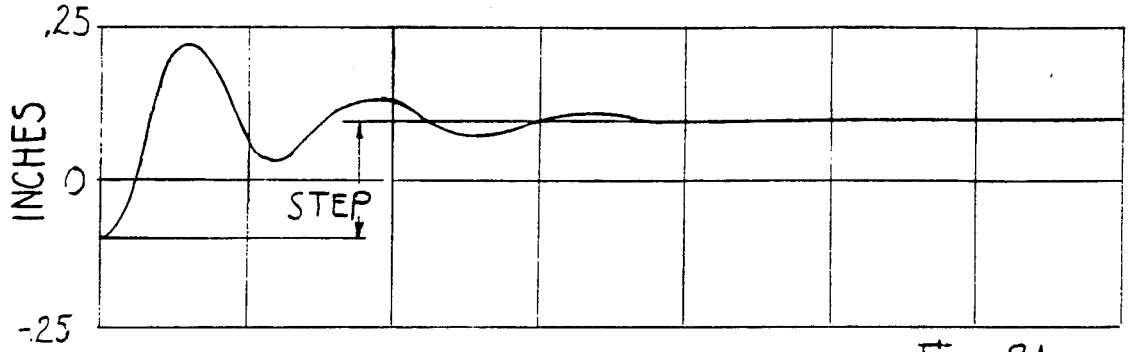
FIG. 8A is a graph showing the transient response of the output spool of a system in accordance with FIG. 7 and with this invention.
Figure 8B:
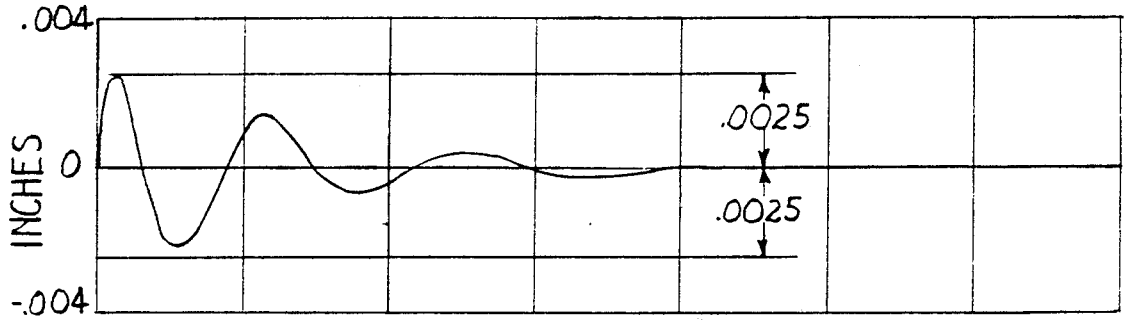
FIG. 8B is a graph showing, on the same time scale as FIG. 8A, the simultaneous response of the flapper valve.
Figure 8C:
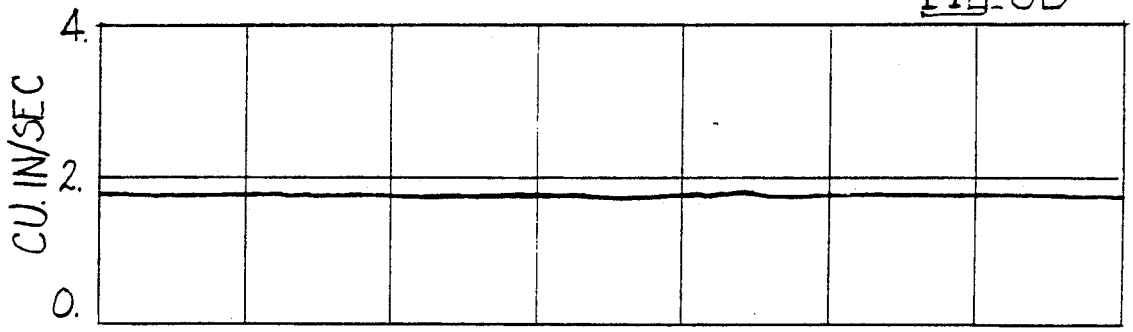
FIG. 8C is a graph showing the simultaneous response of one flow regulator.
Figure 8D:
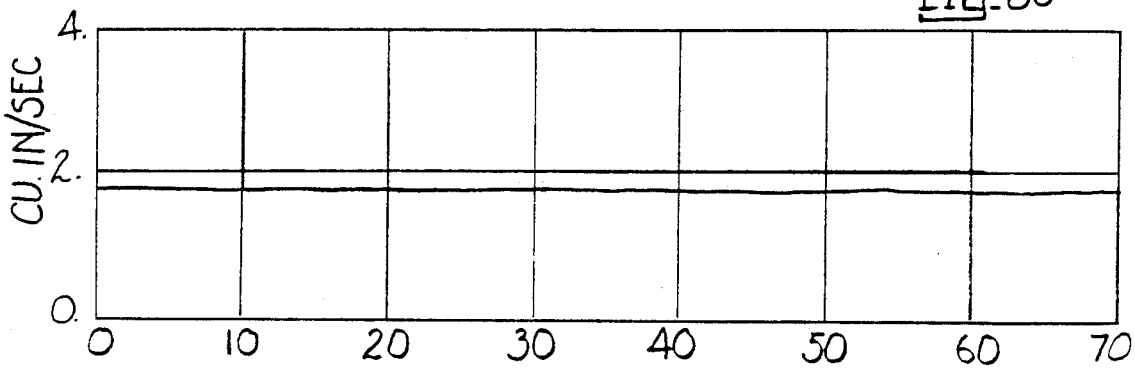
FIG. 8D is a graph showing the simultaneous response of the second flow regulator.

The transient response of the third stage is shown in FIG. 8A the simultaneous response of the flapper in FIG. 8B and the simultaneous response of the flow rate being controlled by flow regulator #1 in FIG. 8C and by flow regulator #2 in FIG. 8D. The supply pressure to the inlet flow regulators and to the second stage spools is 3000 psi. The flapper can be seen to oscillate, causing the flapper orifices to go from maximum to nearly closed. The flapper orifice is in the direct path of the flow regulators, but there is no visible flow disturbance. During the very brief interval of flapper valve shut-off, the flow from the flow regulator is absorbed by the compression of the hydraulic fluid in the flapper junction or second stage displacement. FIG. 8 demonstrates that the flow regulator has very high dynamic response.

Figures 9A, 9B, 9C:
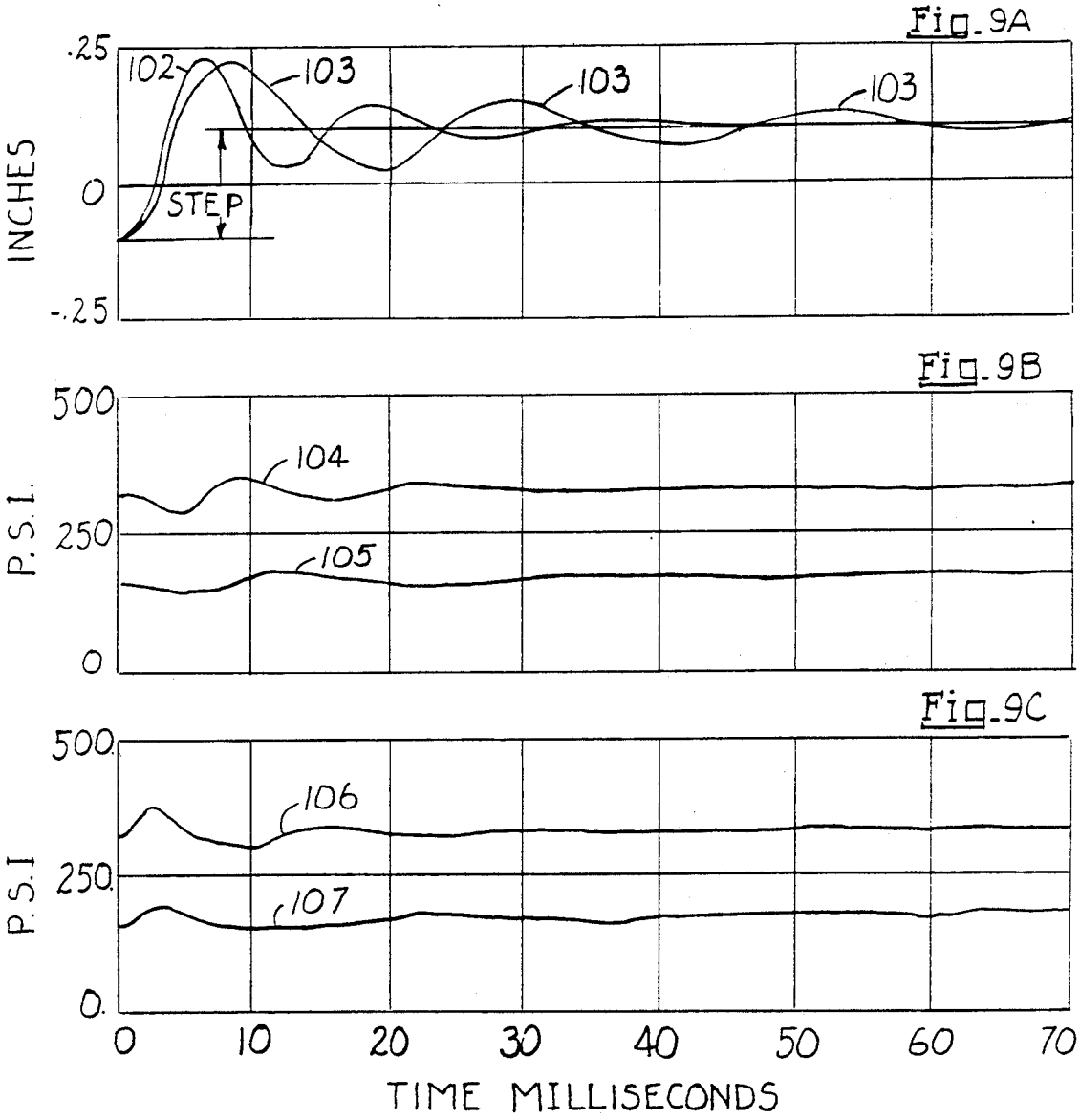
FIG. 9A is a graph showing the transient response of the third stage spool in a system in accordance FIG. 7 and with this invention, superimposed on the transient response of a system using inlet orifices.
FIG. 9B is a graph showing, on the same time scale a FIG. 9A, the simultaneous response of the flapper pressures on a first side of both systems.
FIG. 9C is a graph showing the simultaneous response of the flapper pressures on the second side of both systems.

FIG. 9A shows a comparison of the transient response of the third stage of a system that utilizes inlet flow regulators, line 102 and that utilizes inlet orifices, line 103. The flow regulator line, 102, is identical to the third stage response line of FIG. 8A. The response line of the inlet orifice case was obtained with 500 psi at the inlet orifices and 3000 psi at the second stage spools. It can be readily seen that line 102 rises faster and damps out sooner than line 103. The frequency of oscillation of line 102 is approximately 81 hz and that of line 103 is 47 hz. Line 102 damps completely in 40 milliseconds while line 103 is still oscillatory at 70 milliseconds. A more quantitative effect of the flow regulators can be seen in FIGS. 9B and 9C, which show the variation of the two flapper pressures. Lines 104 and 106 are the inlet flow regulator system responses and lines 105 and 107 are the inlet orifice system responses. The lines are separated because, as stated earlier, the null pressure in the flow regulator case is 322.2 psi and 164.4 psi in the inlet orifice case. It can be seen that the pressure fluctuations in the beginning of the transient are significantly larger on lines 104 and 106 than are on lines 105 and 107. The primary reason for the difference in amplitude of pressure variation can be stated as follows: In the case of the inlet orifice, the flow into the flapper junction increases when the junction pressure falls and decreases when the junction pressure rises. This orifice effect reduces the rate of pressure change in the junction. When this orifice effect is prevented by the replacement of the two inlet orifices with constant flow means, such as high response flow regulators, the rate of pressure change is maximized. The rate of pressure change is further increased by the increased the slope of the pressure to flapper displacement, as shown in FIG. 4.

Figures 10A, 10B, 10C:
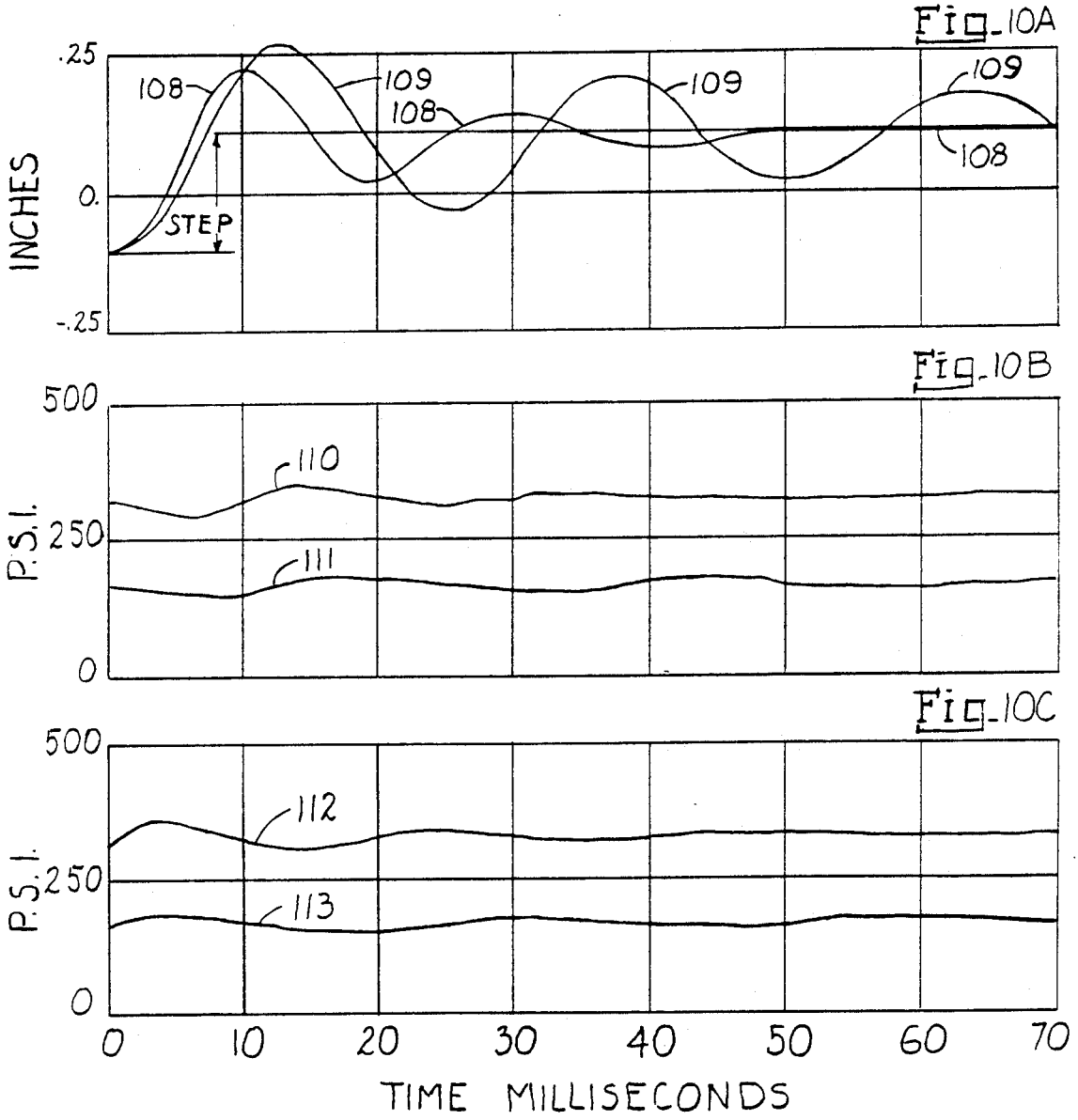
FIGS. 10A to 10C is a set of graphs as shown in FIGS. 9A to 9C, but at a substantially lower second stage supply pressure.

The responses shown in FIGS. 10A–10C are of the same variables as shown in FIGS. 9A–9C, but in this case all pressure supply ports are at 500 psi. All other operating conditions are the same as in FIGS. 9A–9C. In channel 1, the transient response of the inlet flow regulator system is shown on line 108 and the response of the inlet orifice system is shown on line 109. In FIG. 10B, line 110 shows the response of one flapper pressure in the inlet flow regulator system and line 111 shows the response of one flapper pressure in the inlet orifice system. In FIG. 10C, line 112 shows the response of the second flapper pressure in the inlet flow regulator system and line 113 shows the second flapper pressure in the inlet orifice system. In FIG. 10A, line 108 shows a slower initial rise than line 102 of FIG. 9A, as can be expected with a reduction of pressure from 3000 psi to 500 psi. The damping of line 105 shows only a small reduction, with the settling point moving from 40 to 50 milliseconds. The damping shown on line 109 is very low, with significant amplitude of oscillation at 70 milliseconds. The loss of damping at low operating pressure is caused by the increased compressibility of the hydraulic fluid with pressure reduction, in the third stage cylinder ends and the reduction of the flow force spring effect on the action of the second stage spools. These effects are greatly reduced with the use of the flow regulated flapper inlets and the reduction is attributable to the marked increase of flapper pressure difference to flapper displacement and the consequent increased speed of error correction.

Figure 11:
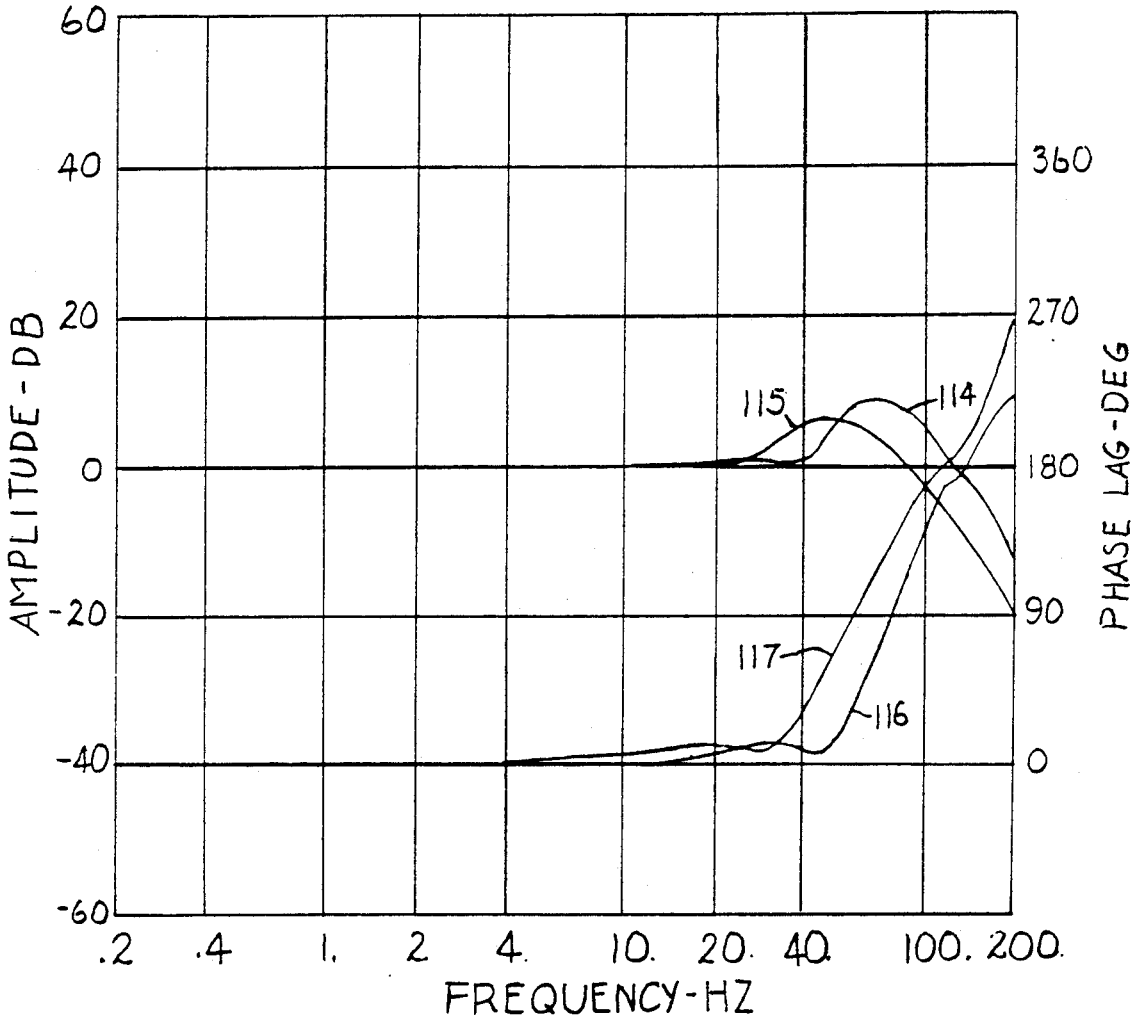
FIG. 11 is a graph showing the frequency response of a system in accordance with FIG. 7 and with this invention with a high pressure at both the flapper valve and the second stage inlets, and also showing the frequency response of the prior art with high pressure at the second stage inlet and the limited low pressure at the flapper valve inlets.

The frequency response of the system of this invention at a supply pressure of 3000 psi is shown in FIG. 11. The frequency response of a comparable flapper inlet orifice system is also shown in FIG. 11. The comparable inlet orifice system uses 3000 psi at the second stage inlets and 500 psi at the flapper stage inlets. Both systems have a null flow rate of 3.525 cu.in./sec.. As in the case of the transient runs, the centering spring rate of the second stage spools is 400 lb./in. in the inlet orifice system and 800 lb./in. in the inlet flow regulator system.

The servo-amplifier gain, as previously defined, is 12 in both cases. The amplitude, line 114 of the inlet flow regulator system starts to rise at 40 hz and the resonant peak occurs at 67 hz. The amplitude line 115 of the inlet orifice system starts to rise at 22 hz and the resonant peak occurs at 47 hz. The phase, line 116 of the inlet flow regulator system starts to rise at 10 hz, dips at 40 hz and crosses 90 degrees at 78 hz. The phase line 117 of the inlet orifice system starts to rise at 4 hz and crosses 90 degrees at 58 hz. The upper frequency limit of the inlet flow regulator system, at negligible amplitude and phase, is 40 hz and for the inlet orifice system is 25 hz. These values translate into a 40% gain in resonant frequency, a 70% gain in 90 degree phase shift and a 60% gain in negligible amplitude and phase shift limit frequency attributable to the use of inlet flow regulators.

Figure 12:
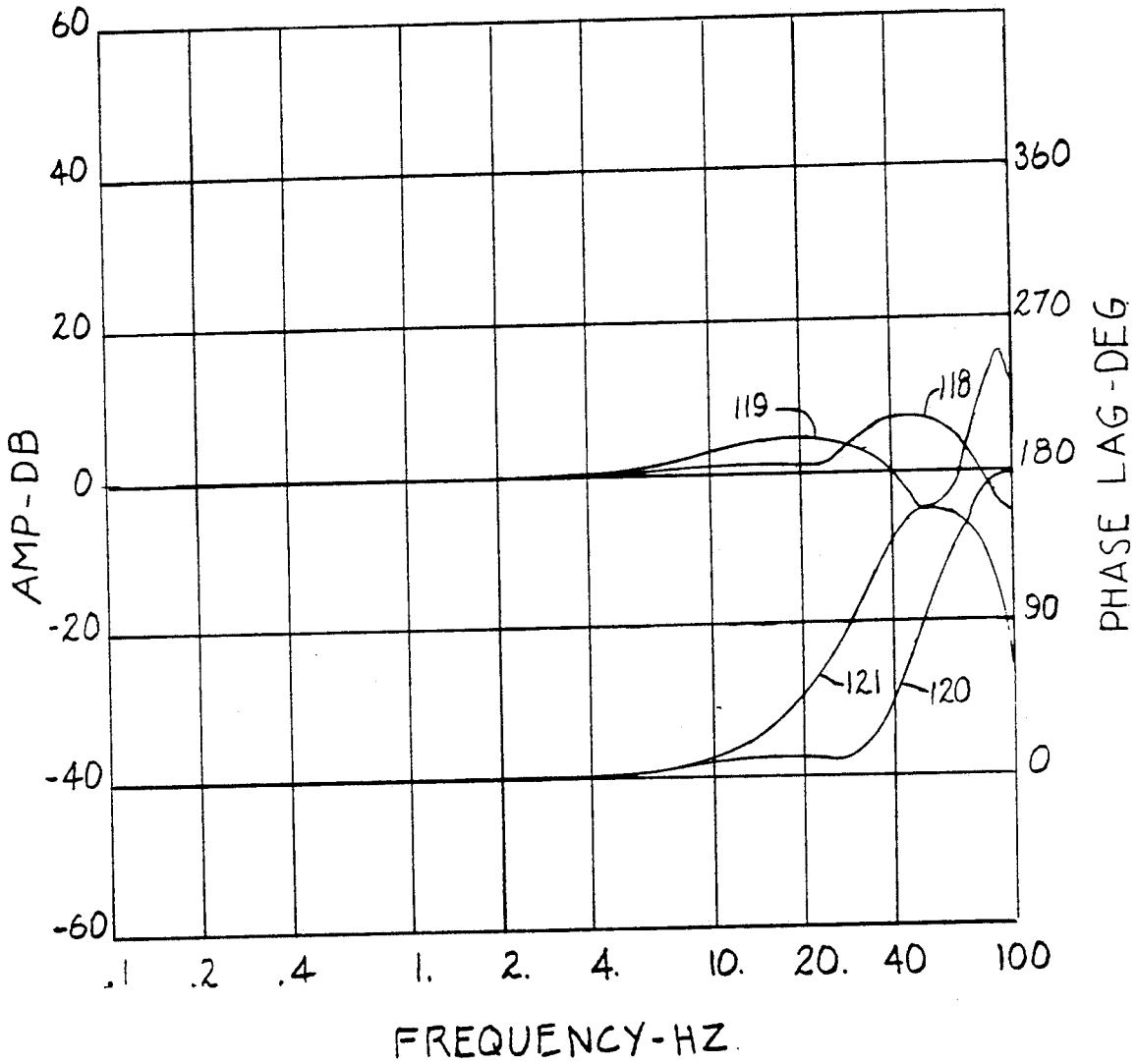
FIG. 12 is a graph showing the frequency response of a system in accordance with FIG. 7 and with this invention and frequency response of the prior art fed system, with all system inlet pressures at the low value of the orifice fed flapper valve.

The frequency response of the system of this invention at a supply pressure of 500 psi is shown in FIG. 12. The frequency response of a comparable flapper inlet orifice system is also shown in FIG. 12. The pressure supplied to the first and second stages is 500 psi and the null flow rate is 3.525 cu/.in./sec. in both systems. As in the transient runs, the centering spring rate of the second stage spools is 400 lb./in. in the inlet orifice system and 800 lb./in. in the inlet flow regulator system. The servo-amplifier gain, as previously defined, is 12 in the inlet flow regulator system and 6 in the inlet orifice system. The reduction of servo-amplifier gain in the inlet orifice system was necessitated by the low damping indicated on line 109 in FIG. 10. In FIG. 12, the amplitude, line 118, of the inlet flow regulator system starts to rise at 20 hz and has a resonant peak at 49 hz. The amplitude, line 119, of the inlet orifice system starts to rise at 4 hz and has a resonant peak at 22 hz. The phase, line 120, of the inlet flow regulator system starts to rise at 6 hz and crosses 90 degrees at 50 hz. The phase, line 121 of the inlet orifice system starts to rise at 6 hz and crosses 90 degrees at 28 hz. The upper frequency limit of the inlet flow regulator system, at negligible amplitude or phase, is 20 hz and for the inlet orifice system is 10 hz. These values translate into a 227% gain in resonant frequency, a 79% gain in 90 degree phase shift frequency and a 100% gain in negligible amplitude and phase shift limit, attributable to the use of inlet flow regulators. It can be further observed that frequency response of the inlet flow regulator system, at a supply pressure of 500 psi is the equivalent of the frequency response of the inlet orifice system with a second stage supply pressure of 3000 psi, shown in FIG. 11.

Figure 13:
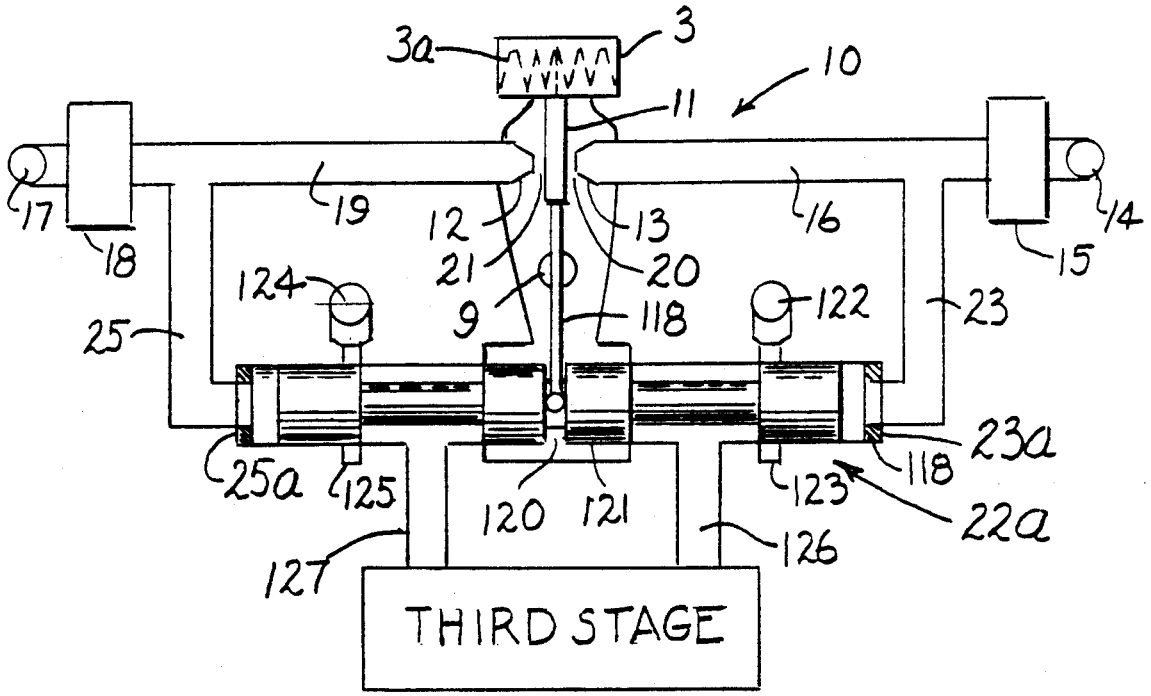
FIG. 13 is a schematic drawing of a two stage servovalve having a first stage flapper valve with undefined inlet devices, driving a second stage flow control spool valve. The second stage spool is coupled to the flapper member by a flexible rod.

A schematic drawing of the system with a high pressure, flow control flapper valve driving a second stage spool valve, with spring feedback of spool position to the flapper, used in this investigation, is shown in FIG. 13. In FIG. 13, flapper valve parts that are common to FIG. 13 and FIG. 1 are identified by the same numbers and the application of FIGS. 2 and 3 is the same as in FIG. 1. Feedback rod 118 is attached to flapper 11 and engages spool 119 in groove 120 with ball end 121. Pressure port 122 feeds annulus 123 and pressure port 124 feeds annulus 125. The inner land of spool 119 returns flow to drain 9. Passages 126 and 127 carry flow to and from the third stage bidirectional load, which may be a spool, cylinder piston or fluid motor. As is well known in the art, feedback rod 118 is flexible, having a effective spring rate on the spool axis that is substantially less than the spring rate of the internal torque motor spring. It is further well known that this mechanism functions to provide an axial position of spool 119 that is proportional to the torque developed by the torque-motor.

Figure 14:
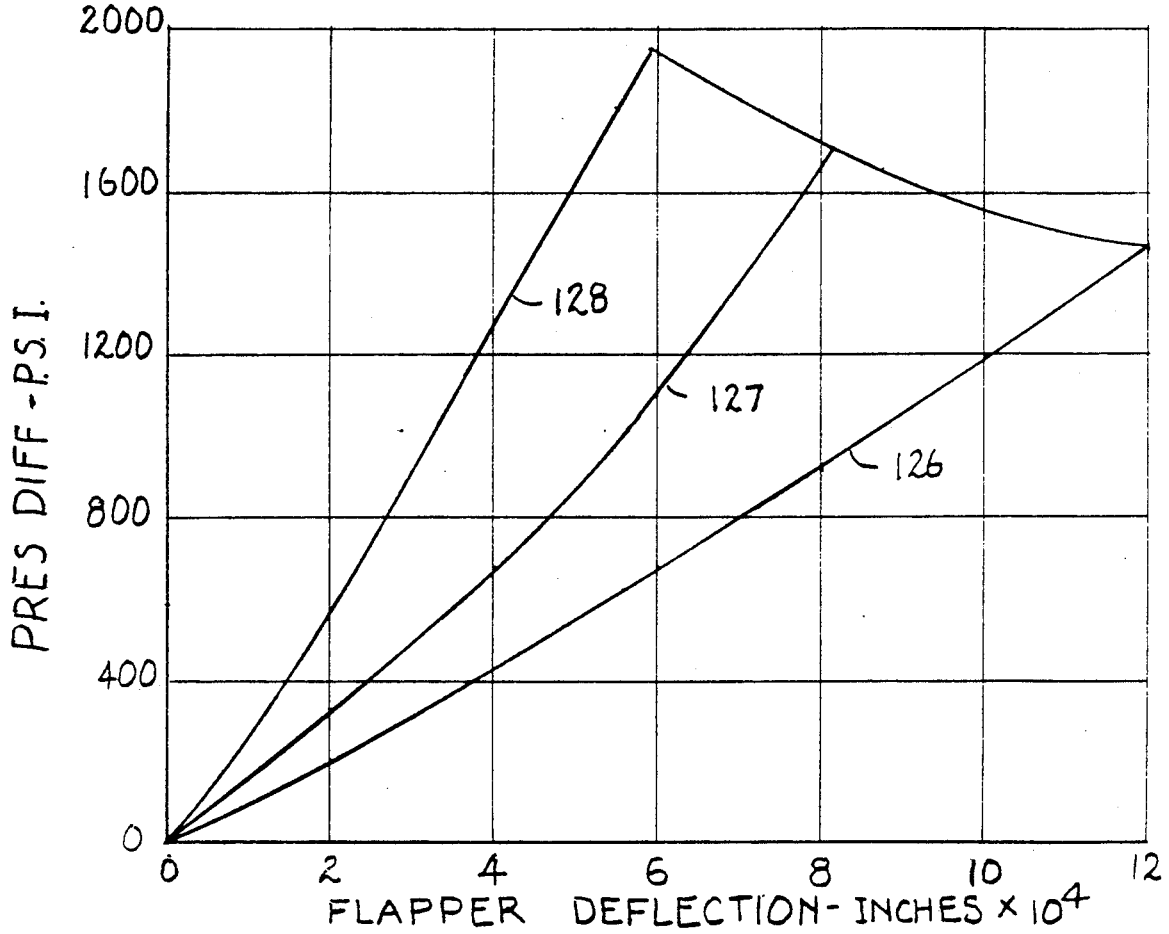
FIG. 14 is a plot showing the blocked load variation of pressure differential with flapper deflection, of a flapper valve employing both inlet orifices and inlet flow regulators and the additional increase in differential pressure with the gap reduction allowable with inlet flow regulators. The differences in deflection and magnitude of differential pressure between FIGS. 4 and 14 will be understood when the physical dimensions are given in the detailed description.

FIG. 14 shows the blocked load variation of pressure differential with flapper deflection of a flapper valve employing both inlet orifices and inlet flow regulators, as calculated by the blocked load equations and the following dimensional data:

TABLE 2

| Flapper and Torque-motor Data | |
|---|---|
| Design supply pressure | 3000 psi |
| Nozzle diameter | .015 inches |
| Inlet orifice diameter | .010 inches |
| Null flapper gap | .0024 inches |
| Null flow rate per side | .353 cu. in./sec. |
| Torque-motor spring rate | 144.2 lb./in. |
| Feedback spring rate | 23.86 lb./in. |
| Max torque-motor force | .4 lbs. |

Note - The last three values are on the nozzle axis.

The blocked load equations are applicable to the system of FIG. 13 because at each position of spool 119 the spool is at rest and there is a force balance between the torque-motor force, the feedback force and the nozzle pressure force. Reduced flapper deflection through increased flapper to pressure gain, as provided by this invention permits, increased feedback spring rate and the accompanying benefit of higher spool holding pressure differentials. In FIG. 14 line 126 displays the orifice fed case and was calculated with equations (1) and (2), with Table 2 values. Lines 127 and 128 were calculated with equations (5) and (6) with the flow regulator flow rate equal to 0.353 cu.in./sec.. On lines 126 and 127 the null gap is 0.0024 inches and on line 128 the null gap is 0.0020 inches. The increase in differential pressure to flapper deflection gain between lines 128 and 126 is approximately 3 and the increase in differential pressure is 500 psi.

Figures 15A, 15B, 15C:
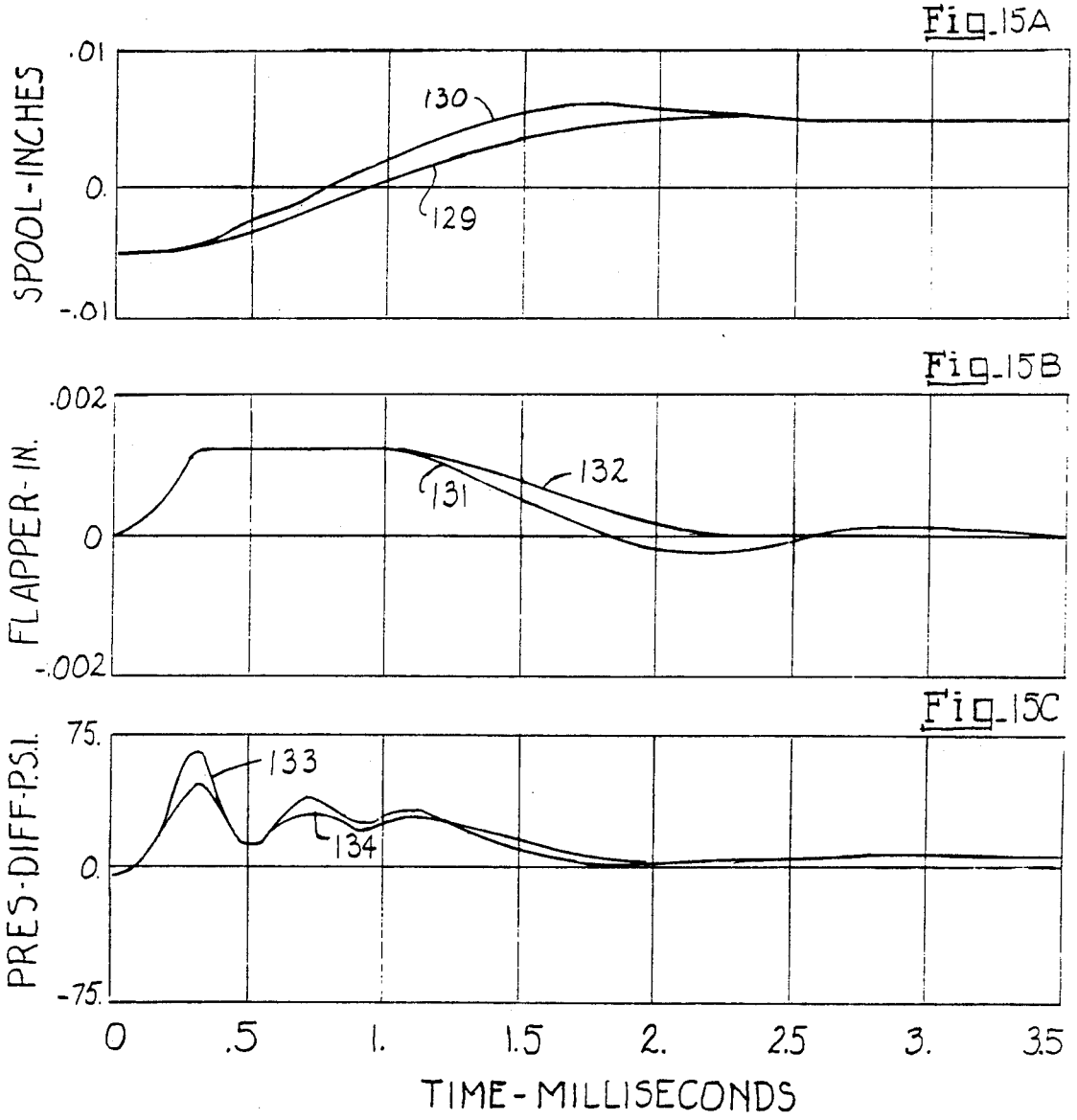
FIG. 15A is a graph showing the transient responses of the output spool in systems in accordance with FIG. 13 and with this invention and with inlet orifices.
FIG. 15B is a graph showing, on the same time scale as in FIG. 15A, the simultaneous response of the flapper valves of both systems.
FIG. 15C is a graph showing the simultaneous responses of the pressure differentials of both systems.

FIGS. 15A–15C display the transient responses of both the orifice fed case and the inlet flow regulator case. The variation of spool displacement is shown in FIG. 15B where line 129 is the response of the orifice fed system and line 130 is the response of the inlet flow regulator system. It can be observed that in a large segment of the response, the spool moves at a constant velocity. This velocity limit is imposed by the output limit of the flapper valve. I calculate, from the trace in channel 1 that the output limit is 0.17 cu.in./sec. on line 129 and 0.22 cu.in./sec. on line 130, a 30% increase. Channel 2 shows the variation of the flapper valve during the transient. It can be seen that it takes approximately 0.0003 seconds for the flapper to reach the 0.0012 inch limit. In the case of the faster moving spool (flow regulator case) line 131 coxes off the limit sooner and drops faster. FIG. 15B is an illustration of the manner in which the force feedback system works. It can be seen that the flapper is very near null position at the beginning of the transient and returns to very near null as the spool approaches the command position. FIG. 15C shows the variation of differential pressure during the transient. Line 133 of the flow regulator system peaks at 60 psi and the orifice system peaks at 48 psi, line 134. It can also be seen that the holding pressure differential at both ends of the transient are approximately +/−4 psi.

Figure 16:
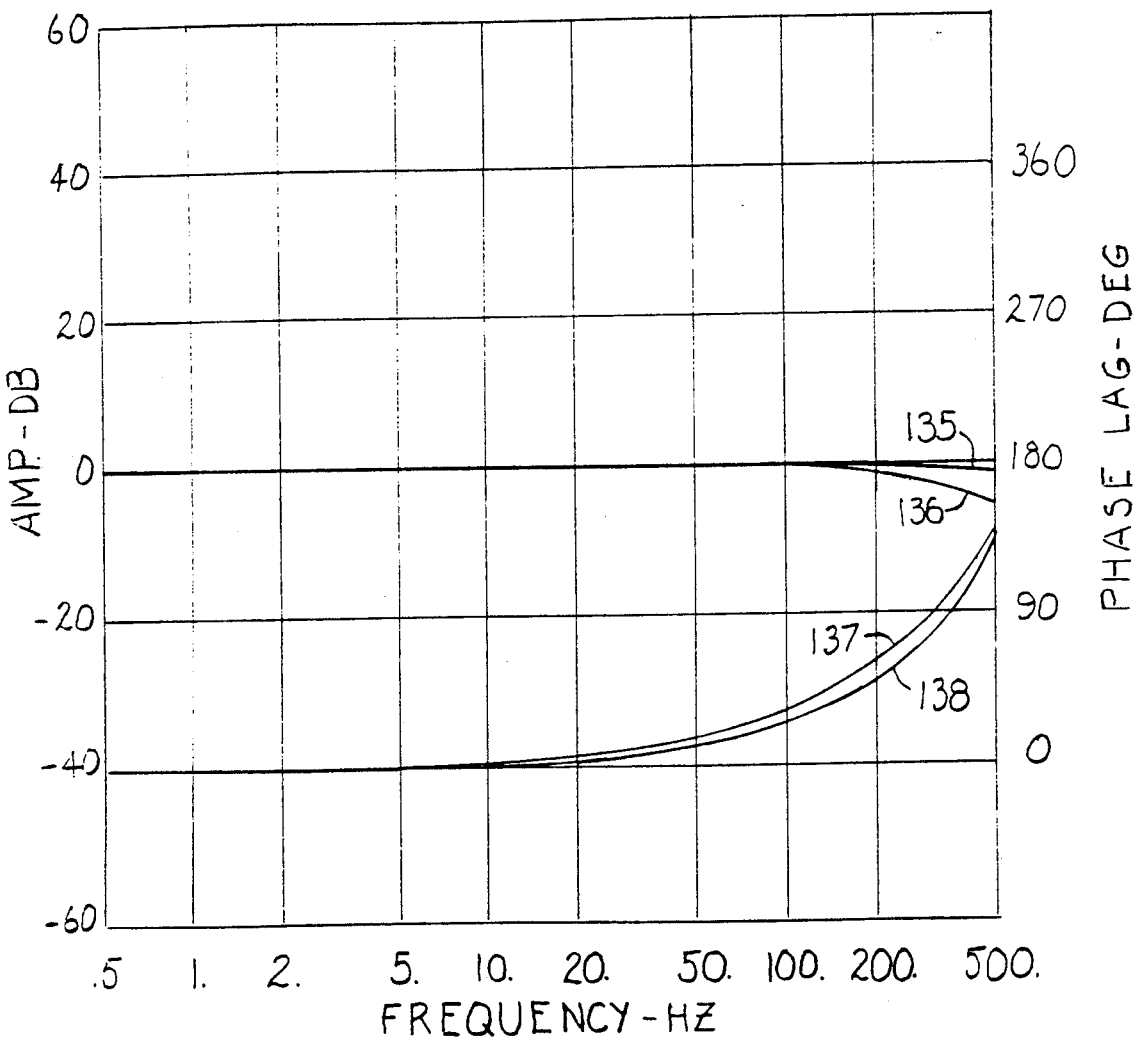
FIG. 16 is graph showing the frequency response of a system in accordance with FIG. 13 and with this invention and with inlet orifices.

FIG. 16 shows the frequency response of the two systems. It can be seen that the amplitude line of the flow regulator system, line 135 is down 1 db at approximately 500 hz and the orifice system, line 136 is down 1 db at approximately 200 hz. The phase lag of the orifice system, line 137 crosses 90 degrees at 317 hz and that of the inlet flow regulator system crosses at 370 hz.

Although the preferred embodiments of this invention have been shown and described in detail, it is recognized that the invention is not limited to the precise form and structure shown and that various modifications and rearrangements, as will occur to those skilled in the art upon full comprehension of this invention, may be resorted to without departing from the scope of the invention, as defined in the claims.

What is claimed is:

1. In a multistage, electro-hydraulic servovalve assembly including a first stage flapper valve assembly and a second stage spool valve assembly, said first stage flapper valve assembly having double jet flapper valve, said double jet flapper valve comprising a first and a second, substantially equal, spaced apart and opposing jet nozzles, a flapper member interposed in the gap formed between said nozzles, spring means centering said flapper member in said gap and electrically operated torque-motor means operable to vary the position of said flapper member in said gap, said flapper valve assembly being in communication with a pressure supply and a drain, and having a first active flow controller means positioned between said pressure supply and said first jet nozzle and a second active flow controller means positioned between said pressure supply and said second jet nozzle, said flapper valve means being operable to produce a variable pressure differential, and said flapper valve assembly having passage means operable to transmit said pressure differential to the spool ends of said second stage spool valve assembly, whereby the spool of said second stage spool valve assembly is axially responsive to said pressure differential and wherein said pressure differential is substantially independent of the pressure level of said pressure supply and the gain of said pressure differential to flapper member movement is greater then can be achieved through the use of orifices in place of active flow controller means.

2. The multistage electro-hydraulic servovalve assembly as set forth in claim 1, wherein said multistage servovalve assembly further includes a third stage spool valve assembly and an electric control system, said second stage spool valve assembly including a first four way valve spool means, said third stage spool valve assembly including a second four way valve spool means, said second four way valve spool means being spring centered and being axially responsive to said pressure differential and being in communication with a pressure supply and with a drain, said second stage spool valve assembly having means operable to transmit flow to and from the spool ends of said third stage assembly in proportion to said pressure differential, said second four way valve spool having axial position detection means, said position detection means having means operable to produce an electrical position signal, said electric control system having means operable to supply electric current to said torque-motor means in proportion to the difference between said second four way valve spool means position signal and an external command signal.

3. The multistage, electro-hydraulic servovalve as set forth in claim 1 wherein said second stage spool valve assembly includes first and second independent spool means, said spool means having two lands with pressure input means and pressure feedback means, said pressure input means communicating with said pressure differential, said independent spool means being in communication with a pressure supply and with a drain, said multistage servovalve further including a third stage, said third stage having a spring centered four way valve spool means, said second stage spool means being operable to transmit said pressure differential to the ends of said third stage spool means, whereby the axial position of said third stage valve spool is made proportional to said pressure differential.

4. In the multistage, electro-hydraulic servovalve assembly as set forth in claim 1, wherein said second stage spool valve assembly includes a four way valve spool means, said four way spool means being axially responsive to said pressure differential, said four way valve spool means being spring coupled to said flapper member, said spring coupling being operative to axially stabilize said four way valve spool means at the axial position that corresponds to the axial force produced by said torque-motor means.

* * * * *